United States Patent [19]

Gollinger

[11] Patent Number: 4,552,067

[45] Date of Patent: Nov. 12, 1985

[54] ROTARY PRINTING MACHINE WITH OFFSET BEARING AND DRIVE FOR AN EXCHANGE CYLINDER

[75] Inventor: Franz X. Gollinger, Wertingen, Fed. Rep. of Germany

[73] Assignee: M.A.N.-Roland Druckmaschinen Aktiengesellschaft, Offenbach am Main, Fed. Rep. of Germany

[21] Appl. No.: 703,283

[22] Filed: Feb. 20, 1985

[30] Foreign Application Priority Data

Feb. 29, 1984 [DE] Fed. Rep. of Germany ..... 3407428

[51] Int. Cl.[4] ..... B41F 13/20; B41F 13/44

[52] U.S. Cl. ..... 101/216; 101/217

[58] Field of Search ..... 101/216, 217, 218, 212, 101/177, 180, 182, 184, 185, 136, 137, 139, 140, 141–145, 247, 350; 308/37.1, 8.1

[56] References Cited

U.S. PATENT DOCUMENTS 3,470,816 10/1969 Piecha et al. ..... 101/218 X
4,183,297 1/1980 Skiera ..... 101/218
4,301,728 11/1981 Jaffe et al. ..... 101/218

FOREIGN PATENT DOCUMENTS

EP17720 10/1980 European Pat. Off. ..... 101/177

*Primary Examiner*—J. Reed Fisher
*Attorney, Agent, or Firm*—Frishauf, Holtz, Goodman & Woodward

[57] ABSTRACT

To permit placement of an exchange or replacement cylinder, such as an Anilox inker roller between side walls (1) of a printing machine which is formed with openings to receive rollers of an inker for a raised letter, or offset printing system, and positioned such that the larger diameter Anilox roller will not fit into an existing opening, an arrangement is provided to relocate the center of rotation (*7a*) of the Anilox roller (7) with respect to the center (*6a*) of an existing opening which includes an axially (15) journaled in the existing opening and rotating about the original bearing axis (*6a*), the axially shaft having two spur gears (16, 17) at its ends, projecting, respectively, inwardly and outwardly of the side wall (1). The spur gears are engaged by inwardly geared ring gears (19, 22) respectively, one ring gear (19) being located outside of the side walls and journaled for rotation about the replacement axis (*7a*) by a flanged bearing bolt (18) secured the side wall, for example, and preferably including an outer gear (19*a*) to receive drive power. A, preferably similar, inwardly geared ring gear (22) meshes with the inner spur gear (16), the inner ring gear being secured to a stub shaft (23) on the Anilox roller, rotatable about the replacement axis of rotation (*7a*), and retained in place by bearing (24) located within the bearing housing (25) which, preferably, can be rocked about the original bearing axis (*6a*), by being connected over bearings (27) with the side wall (1) of the machine, so that the Anilox roller (7) can be rocked in and out of engagement with an existing plate cylinder.

10 Claims, 2 Drawing Figures

20
21
19
19a
17
1
14
15
11
12
13
16
6a
7a
22
25
24
7
18
27
26
23
X

ROTARY PRINTING MACHINE WITH OFFSET BEARING AND DRIVE FOR AN EXCHANGE CYLINDER

The present invention relates to a rotary printing machine and more particularly to a rotary printng machine in which a plurality of printing cylinders and/or rollers are journaled, and which printing machine is to be adapted, or modified by replacing a cylinder having a defined bearing location in the side walls of the machine with another cylinder requiring a different bearing location, without reconstructing the side walls of the machine, and to an arrangement permitting such exchange and drive for the exchange cylinder.

BACKGROUND

It is well known that rotary printing machines used, for example, in raised letter printing, offset printing or the like have side walls which are formed, in alignment, with bores for bearings which journal the respective cylinders and rollers required for printing in the side walls of the machine. The drives for the cylinders or rollers are generally provided by spur gears located at the outside of one of the side walls and forming a gear train.

It is sometimes desirable to change printing systems or printing methods. For example, it is desired by some printers to change rotary printing machines designed for raised letter printing to Flexo printing. Retro fitting such a printing machine permits elimination of a number of rollers and cylinders of the inker, thus freeing bores and openings in the sides of the printing machine. The roller required for Flexo printing, that is, the roller for inking of the Flexoplate cylinder, termed the "Anilox" rollers, must have a pre-determined diameter relation with the Flexo print plate cylinder. Generally, the diameter of the Anilox roller is greater than the diameter of the rollers of the inker, that is, the milling rollers, for example, of inker roller trains used with raised letter press. When it is desired to retrofit a printing machine designed for raised letter printing, to change over to flexo printing, it is not possible to merely place the Anilox roller in an existing bore or opening of side walls of the printing machine, originally designed for raised letter printing.

THE INVENTION

It is an object to provide an arrangement which permits positioning a driven exchange cylinder, for example, an "Anilox" roller in a printing machine at a position in which the center of rotation of the replacement or exchange cylinder is offset with respect to the center of any one of the bores for bearings present in the side walls of the machine. The newly established center of rotation, or axis of the replacement or exchange cylinder, with respect to another existing cylinder of the machine should be selectable within wide limits, the original direction of rotation sould be retained while further permitting a freely selectable transmission ratio for the circumferential speed of the replacement or exchange roller, so that it can be matched to the circumferential speed of the other rollers or cylinders in the machine.

Briefly, bearings or journals are fitted into an existing opening. An auxiliary shaft is rotatably secured in the bearings, and extending outwardly beyond the side walls and at least inwardly between the side walls, but not across the machine, and rotatable about the bearing access. Its spur gear is secured to the axially shaft laterally on at least one of the walls. An inner, inwardly geared ring gear matches with the spur gear, located inwardly between the side walls. A shaft is connected between the ring gear and the replacement cylinder concentric with the replacement axial; and the bearing outwardly surrounds the inner ring gear and locates the inner, inwardly geared ring gear in position of the side wall by engaging an outer circumference thereof. In accordance with a feature of the invention, an outer outwardly geared ring gear matches with the spur gear, located outside of at least one of the side walls, the ring gears both being positioned with their centers on the replacement axial and hence offset eccentric with respect to the original bearing axial. The outer inwardly geared gear may carry an additional outer gear ring for receiving rotation transfer from the drive system of the machine thus driving the spur gear at the outset of the side wall and through the stop shaft the preferably similar spur gear at the inner end of the stop shaft which matches with the other inwardly geared ring gear which, in turn, is coupled to the shaft in which the replacement cylinder is located.

It is well known in mechanical engineering to utilize inwardly geared ring gears; such gears, however, do not permit rocking of the stub shaft from which the drive is taken. In the system of the present invention, a relatively wide rocking of the stub shaft, which in the structure of the present invention forms the center of rotation for the newly placed a replacement roller is possible. The value of the eccentric offset X between gears located in the openings of the side wall and eccentrically located inwardly geared ring gears permits this eccentric offset. The transmission ratio is freely selectable. Preferably, the arrangement is formed as two similar gear drives, that is, two gear drives forming the mirror image of each other. The result will be that the direction of rotation of the replacement roller will be the same as that of the roller which it originally replaced in the bores which were present in the side walls of the machine.

DETAILED DESCRIPTION

Figure 1:
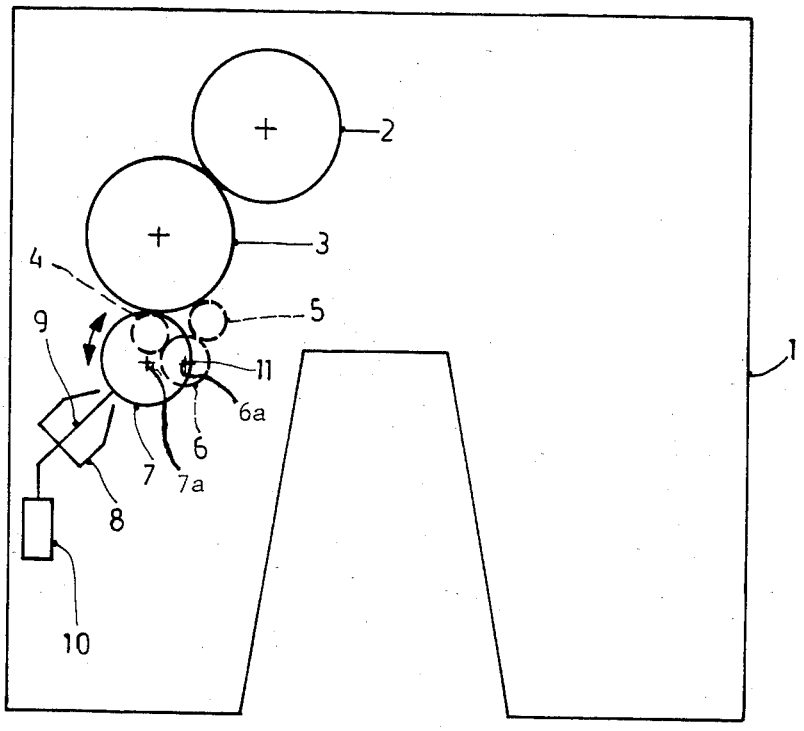
FIG. 1 is a highly schematic side view of a rotary printing machine which is to be changed over or retrofitted from raised letter printing to flexo printing.

The schematic representation of FIG. 1 shows one of a pair of side walls 1, in which an impression cylinder 2 is journaled, for printing contact with a plate cylinder 3. The cylinders 2, 3 are journaled in the side walls 1 and have extending stub shafts, extending into bearings in the side walls. The inking rollers required to ink the plate cylinder 3 which, for example, is a raised letter press cylinder, are shown by the broken line rollers for, 5, 6. Inking of the plate cylinder 3 in a raised letter press can be accomplished by two application roller 4, 5 which, in turn, are supplied with ink from a milling roller 6. Other rollers of the inker are not shown and may be constructed in accordance with any well known inker structure. The application rollers 4, 5 as well as the milling roller 6 are located in suitable bores or openings in the side walls 1 of the printing machine.

If it is desired to change the printing mode of such a printing machine to flexo printing, then the application rollers 4, 5 and the milling roller 6 are removed. This, then, releases the respective bores in the side walls 1 of the machine. To change the machine over to flexo printing, an inking Anilox roller 7 is required. The diameter of the Anilox roller 7 is generally larger than the diameter of the inking roller 4,5, and of the milling roller 6 required for raised letter printing. Consequently, the center of rotation 6*a* within the bore 11 for the roller 6 will become free and a new center of rotation 7*a* for the Anilox roller 7 will be required. The freed bore 11 does not permit placement of the Anilox roller and its substantially larger diameter into the printing machine, as constructed, with the existing bores.

The present invention is directed to a structure which permits an offset location of the center of rotation 7*a* of the Anilox roller 7, and drive from drive gearing which is designed for engagement with a roller having the center of rotation 6*a*. The Anilox roller 7 is inked by an inker 8 in accordance with a well known inker structure to provide a film of ink thereon. The Anilox roller 7 has a doctor blade in engagement therewith, as schematically shown at 9, which is engaged on the Anilox roller 8 by a cylinder 10, as well known, and in accordance with any suitable commercial structure.

Figure 2:
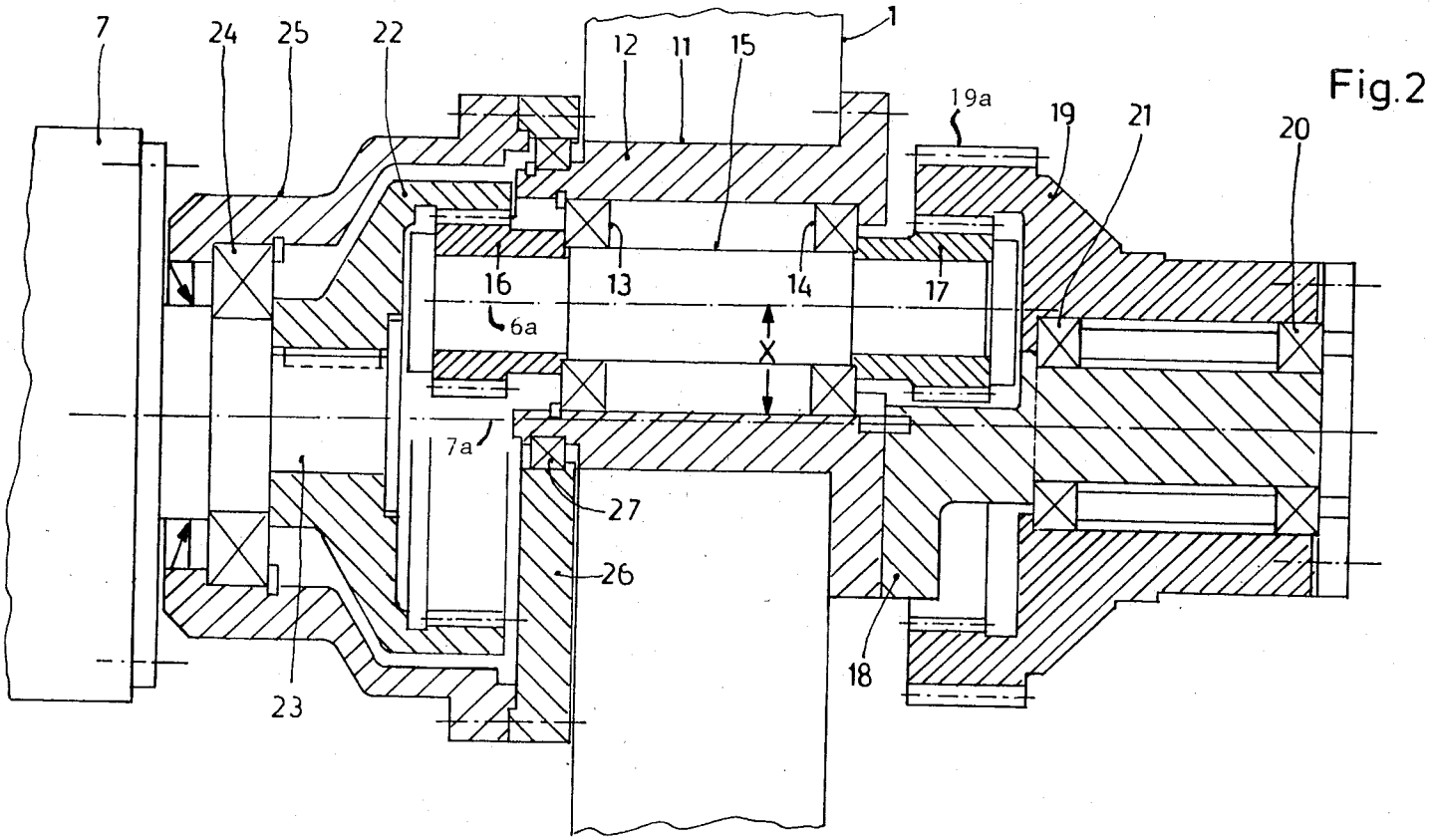
FIG. 2 is an axial sectional view through the bearing and drive arrangement at one of the side walls of the machine permitting placement of an Anilox roller.

In accordance with a feature of the invention, a flanged bearing sleeve 12 (FIG. 2) is fitted into the bore 11, which was freed by removal of the milling roller 6. The bearing sleeve 12 extends over both sides of the side wall 1 and has bearings 13,14 located therein to rotatably retain an auxiliary shaft 15. The auxiliary shaft extends on both sides of the side wall 1 beyond the bearing sleeve 12.

The two ends of the auxiliary shaft 15 have respective spur gears 16, 17 secured thereto, for example by being splined thereon. Preferably, both spur gears 16, 17 have the same pitch and the same number of teeth. The spur gear 17, at the outside of the machine, meshes with a ring gear 19 having an inwardly placed gearing. The ring gear 19 is rotatable about bearings 20, 21 seated on a flanged extention 18 secured to the outer side of side wall 1. As can be clearly seen in FIG. 2, the center of rotation 7*a* of the ring gear 19, of course, also of the bearings 20, 21 is offset eccentrically with respect to the spur gear 17 by the eccentricity X, determined by the lateral shift of the two centers of rotations or axes 6*a*, 7*a*. The inner geared ring 19 is so retained on the bearings 20, 21 that the gear 19 is freely rotatable and continuously meshes with the spur gear 17. The ring gear 19 additionally carries an outer gearing 19*a* which is designed to mesh with an already present gear drive or gear train of the machine. If necessary, additional gears could be interposed. By driving the outer gear 19*a*, the spur gear 17, and hence stub shaft 15 will be driven.

The inner end of the stub shaft 15, that is, at the end between the side walls, a spur gear 16 is located, rotating with the stub shaft, which spur gear 16 meshes with an inwardly geared ring gear 22. Preferably, the number of teeth of the gear 22 are the same as the number of teeth of the gear 19 at the outside of the side walls. The inwardly geared gear ring 22 is secured to the stub shaft 23, to rotate therewith, the stub shaft 23 extending from the Anilox roller 7, so that the Anilox roller 7, needed for flexo printing, will be driven in the same direction of rotation as the milling roller 6 previously used for raised letter printing and previously located in the opening 11 of the side wall 1.

The relationships of diameters of the spur gears 16 17 and the ring gears 19, 22 respectively, are freely selectable. Thus, the surface speed of the Anilox roller 7 can readily be matched to the surface speed of the remaining rollers or cylinders, that is, specifically, of the plate or stencil cylinder 3 which is immediately adjacent Anilox roller 7. The speeds, in relation to the respective diameters, can thus be readily matched by simple calculation.

The stub shaft 23 is journaled in a bearing 24 retained in a bearing housing 25. Bearing housing 25 is attached to a plate 26, the plate 26 being rotatable over a bearing 27 with respect to the flanged sleeve 12. Thus, the bearing housing 25 as well as the Anilox roller 7 can be pivoted about the bearing 27 to permit movement of Anilox roller 7 to and from the plate or stencil cylinder 3 respectively, for example for cleaning etc. By making the pitch circle of the gear 19 equal to the diameter of the Anilox roller 7, identical circumferential speed can be obtained; if there are differences in diameter, or different pitch circles of the gears 19 and 22 are used, the circumferential speed, or the speed of the rollers, respectively, can be suitably changed or selected; the pitch diameters of the gears 7, 16, 17, likewise, may be changed. The advantage of the substantial axial offset X of the shaft 15, with its center axis of rotation 6*a*, with respect to the shaft 23 with its axis of rotation 7*a* is retained.

I claim:

1. Rotary printing machine having a pair of spaced side walls (1);

opening (11) formed in said side walls at predetermined locations to receive bearings for a plurality of printing machine rollers and cylinders (2, 3, 4, 5, 6)

and comprising, in accordance with the invention means for positioning a driven exchange cylinder (7) between the side walls (1) and a position in which a replacement axis of rotation (7*a*) of the exchange cylinder (7) is offset (x) from the position of a bearing axis (6*a*) of an existing opening (11) in said side walls including journal means (12,13, 14) fitted in said opening (11);

an auxiliary shaft (15) rotatably secured in the journal means rotatable about the bearing axis (6*a*) and extending beyond the side walls at least inwardly between the side walls;

a spur gear (16, 17) secured to the auxiliary shaft laterally of at least one of the side walls (1);

an inner, inwardly geared gear ring (22) meshing with the spur gear (16) located inwardly between the side walls, said ring gear (22) being positioned with its center of rotation on said replacement axis (7*a*) and hence offset and eccentric with respect to the bearing axis (6*a*);

a shaft (23) connected between the ring gear (22) and said replacement cylinder (7) concentric with said replacement axis (7*a*); and a bearing (24, 27) journalling said inner ring gear (22) and locating said inner ring gear in position on the side wall (1).

2. Machine according to claim 1 wherein two spur gears (16,17) are secured to the auxiliary shaft, one each being located at the inside and at the outside, respectively of the side wall (1);

and an outer, inwardly geared ring gear (19) is provided, meshing with the spur gear (17) located outside of the respective side wall, said outer ring gear being positioned with its center of rotation on said replacement axis (*7a*).

3. Machine according to claim 2 wherein the outer ring gear (19) includes means (19*a*) to receive rotary drive power.

4. Machine according to claim 1 wherein the journal means fitted into said opening (11) includes a flanged bearing sleeve (12) fitted into said opening;

bearings (13,14) fitted into said flanged sleeve and journalling said auxiliary shaft (15);

and wherein the bearing for journalling the inner ring gear (22) comprises a bearing housing (25) rotatably journaled on the flanged sleeve, and a shaft bearing (24) within the bearing housing and journalling the shaft (23) connecting the inner ring gear (22) and said replacement cylinder (7), rotatable about said replacement axis (*7a*).

5. Machine according to claim 4 further including a bearing housing support bearing (27) rotatably retaining the bearing housing on the flanged sleeve (12) to permit rocking the bearing housing about the bearing axis (*6a*) to move the exchange cylinder into selected positions with respect to a remaining existing machine cylinder (3).

6. Machine according to claim 4 wherein two spur gears (16, 17) are secured to the axially shaft, one each being located at the inside and at the outside, respectively of the side wall (1);

and an outer, inwardly geared ring gear (19) is provided, meshing with the spur gear (17) located outside of the respective side wall, said outer ring gear being positioned with its center of rotation on said replacement axis (*7a*);

further including a flanged bolt (18) secured to the flanged sleeve (12); and bearings (20,21) for the outer and inwardly geared gearing (19) being secured to said flanged belt.

7. Machine according to claim 6 wherein the outer ring gear (19) includes means (19*a*) to receive rotary drive power.

8. Machine according to claim 2 wherein the spur gear (16,17) secured to the respective ends of the axially shaft (15) have the same number of teeth;

and wherein the inner and outer inwardly geared ring gears (22, 19) have the same number of teeth.

9. Machine according to claim 6 wherein the spur gear (16, 17) secured to the respective ends of the axially shaft (15) have the same number of teeth.

10. Machine according to claim 1 wherein the exchange cylinder (7) comprises an Anilox roller of a printing machine changed from offset or raised letter printing to flexo printing mode, the Anilox roller being part of a flexo printing inker.

* * * * *